US007540774B1

(12) United States Patent
Hung et al.

(10) Patent No.: US 7,540,774 B1
(45) Date of Patent: Jun. 2, 2009

(54) COAXIAL CONNECTOR

(75) Inventors: Pei-Chiao Hung, Tu-Cheng (TW); Sheng-Nan Yu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/149,118

(22) Filed: Apr. 28, 2008

(51) Int. Cl.
*H01R 9/05* (2006.01)

(52) U.S. Cl. ..... 439/582

(58) Field of Classification Search ..... 439/582, 439/585, 581, 578, 610, 63
See application file for complete search history.

(56) References Cited

U.S. PATENT DOCUMENTS 6,712,645 B1 * 3/2004 Chou ..... 439/582
6,790,082 B2 * 9/2004 Obayashi ..... 439/582
6,837,743 B2 * 1/2005 Ko ..... 439/582
6,971,913 B1 * 12/2005 Chu ..... 439/582
6,997,745 B2 * 2/2006 Ikeda ..... 439/582
7,351,067 B2 * 4/2008 Chen et al. ..... 439/63
2005/0064734 A1 * 3/2005 Chang et al. ..... 439/63

* cited by examiner

*Primary Examiner*—Alexander Gilman
(74) *Attorney, Agent, or Firm*—Rosenberg, Klein & Lee

(57) ABSTRACT

A coaxial connector includes a housing having a base portion and a tubular portion underneath the base portion. A passageway is defined in both the base portion and the tubular portion. An accommodation space is defined in the base portion and communicates with the passageway. A terminal is received in the passageway and the accommodation space and is connected physically and electrically to an inner conductor of a coaxial cable. A shell includes a sleeve portion accommodating the base portion and the tubular portion of the housing and an outer cover portion. Two arms extend from two sides of an upper portion of the sleeve portion. Each of the arms defines a hook at a tip thereof. The outer cover portion defines two retaining grooves at two sides thereof for holding the two hooks when the shell holds the coaxial cable.

5 Claims, 5 Drawing Sheets

COAXIAL CONNECTOR

BACKGROUND OF THE INVENTION

1. Field of the Invention

The present invention relates to a connector, and particularly to a coaxial connector adapted to be assembled to a coaxial cable.

2. The Related Art

Coaxial connectors are often used for connecting a coaxial cable with an electronic device for transmitting radio-frequency (RF) signals. For example, such a conventional coaxial connector is disclosed in U.S. Pat. No. 6,508,668. With reference to FIG. 1, the coaxial connector includes a dielectric housing 2' holding a central terminal 1' within an outer conductor shell 3'. The dielectric housing 2' is substantially cylindrical and defines a passageway 20' therein for receiving the central terminal 1' and an inner cover portion 21' adapted for covering the central terminal 1'. The outer conductor shell 3' has a sleeve portion 30' for accommodating the dielectric housing 2' and an outer cover portion 31'. The outer cover portion 31' of the conductor shell 3' is bent at right angle together with the inner cover portion 21' of the dielectric housing 2' to hold the central terminal 1' and an inner conductor 41' of a coaxial cable 4' within the dielectric housing 2'.

However, when the outer cover portion 31' of the conductor shell 3' is bent to cover the dielectric housing 2', the outer cover portion 31' often diverges from the direction along the axis of the coaxial cable 4', which will cause the orientation of the conductor shell 3' to be inexact.

SUMMARY OF THE INVENTION

Accordingly, an object of the present invention is to provide a coaxial connector. The coaxial connector adapted to be assembled to a coaxial cable with an inner conductor and a braiding layer encasing the inner conductor, includes a dielectric housing having a base portion and a tubular portion underneath the base portion. A passageway is defined in both the base portion and the tubular portion. An accommodation space is defined in the base portion and communicates with the passageway for accommodating the inner conductor therein. A terminal is received in the passageway and the accommodation space of the dielectric housing and contacts the inner conductor of the coaxial cable. A conductor shell includes a sleeve portion accommodating the base portion and the tubular portion of the dielectric housing and an outer cover portion for covering on the base portion and holding the cable. Two arms extend from two sides of an upper portion of the sleeve portion for holding the braiding layer of the coaxial cable therebetween. Each arm defines a hook at a tip thereof. The outer cover portion defines two retaining grooves at two sides thereof for holding the two hooks when the conductor shell holds the coaxial cable.

As described above, the arms of the conductor shell provide hooks engaging with the retaining grooves of the outer cover portion to fix the outer cover portion in right position when the conductor shell holds the coaxial cable, which prevents the outer cover portion diverging from the direction of the axis of the cable. The orientation of the conductor shell is simple and exact.

BRIEF DESCRIPTION OF THE DRAWINGS

The present invention will become apparent to those skilled in the art by reading the following description of a preferred embodiment thereof, with reference to the attached drawings, in which.

DETAILED DESCRIPTION OF THE PREFERRED EMBODIMENT

Figure 1:
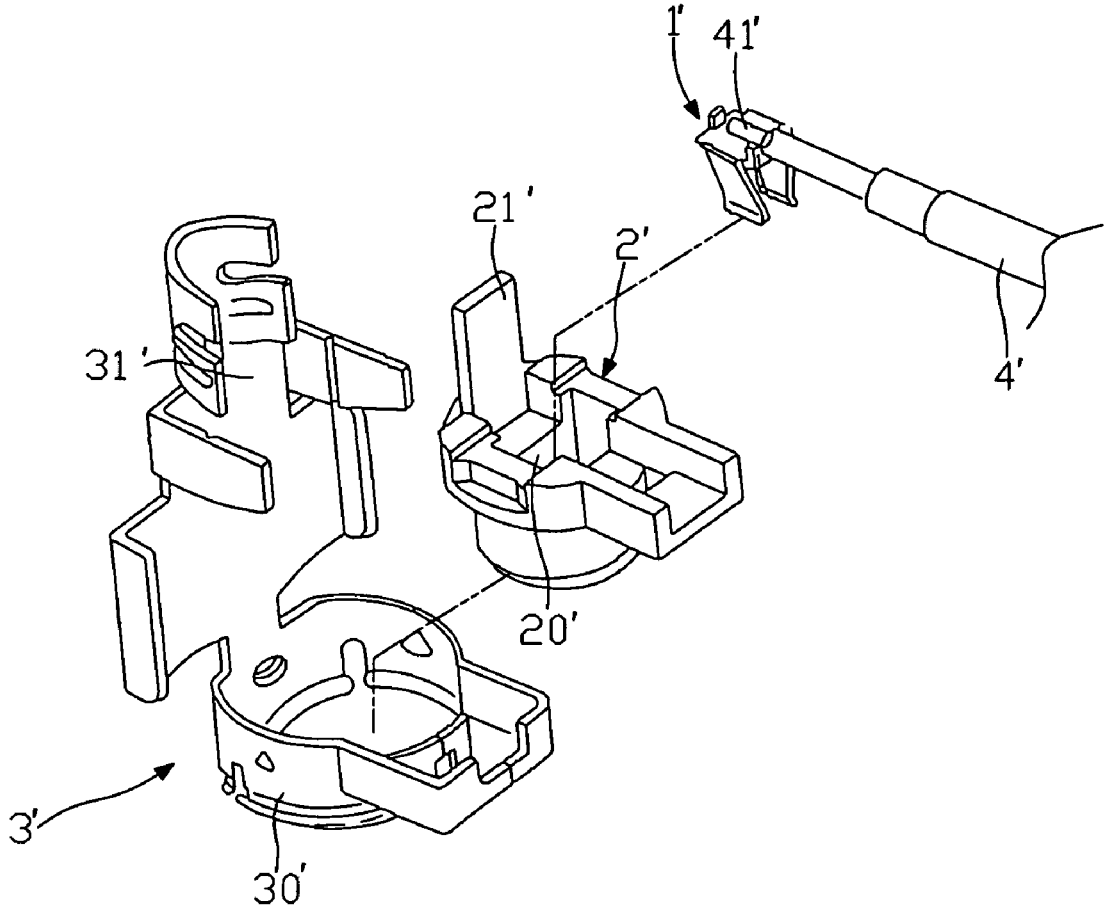
FIG. 1 (Prior Art)
FIG. 1 is an exploded view of a conventional coaxial connector with a coaxial cable to be assembled therein.
Figure 2:
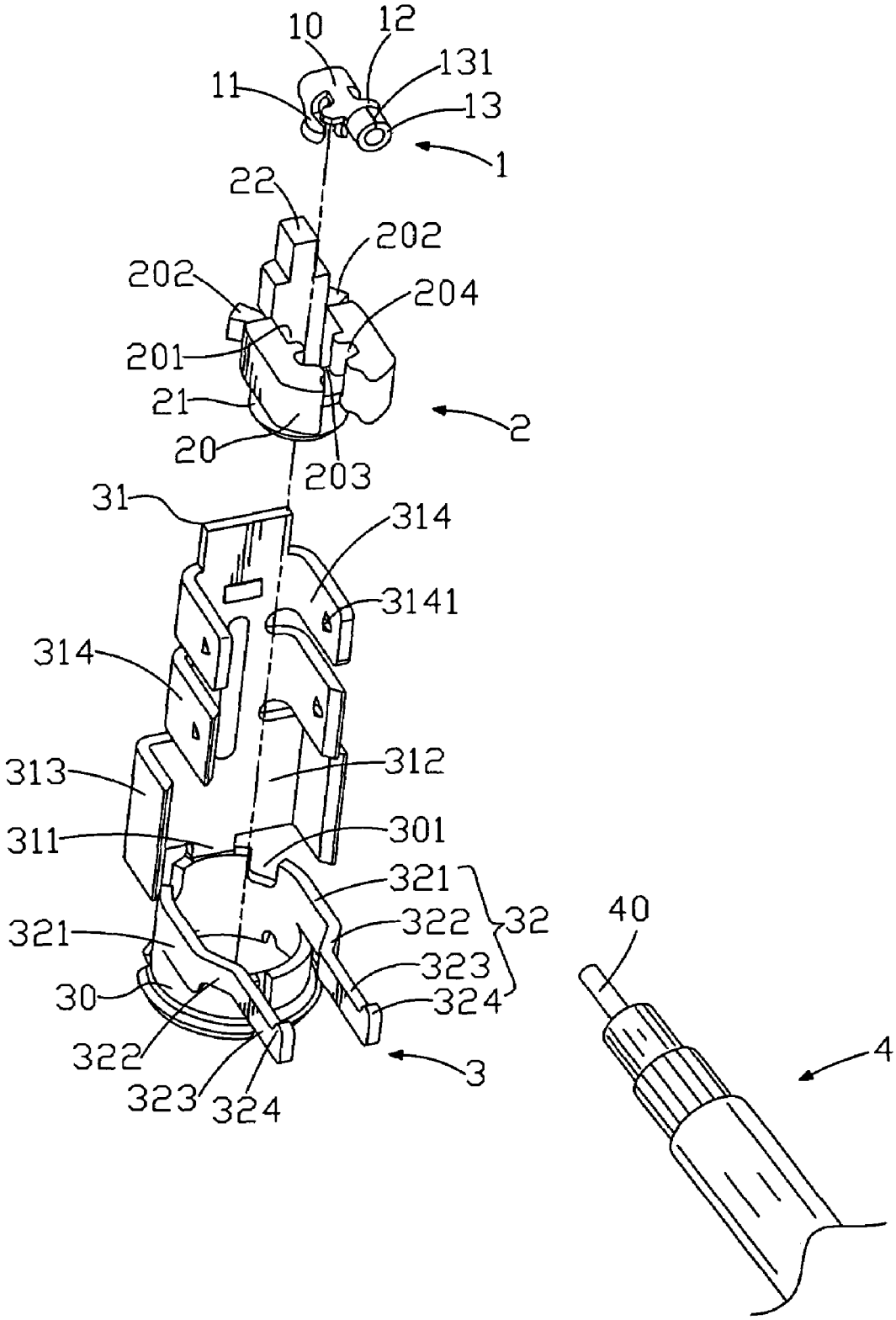
FIG. 2 is an exploded view of a coaxial connector according to the present invention and a coaxial cable to be engaged therewith.
Figure 3:
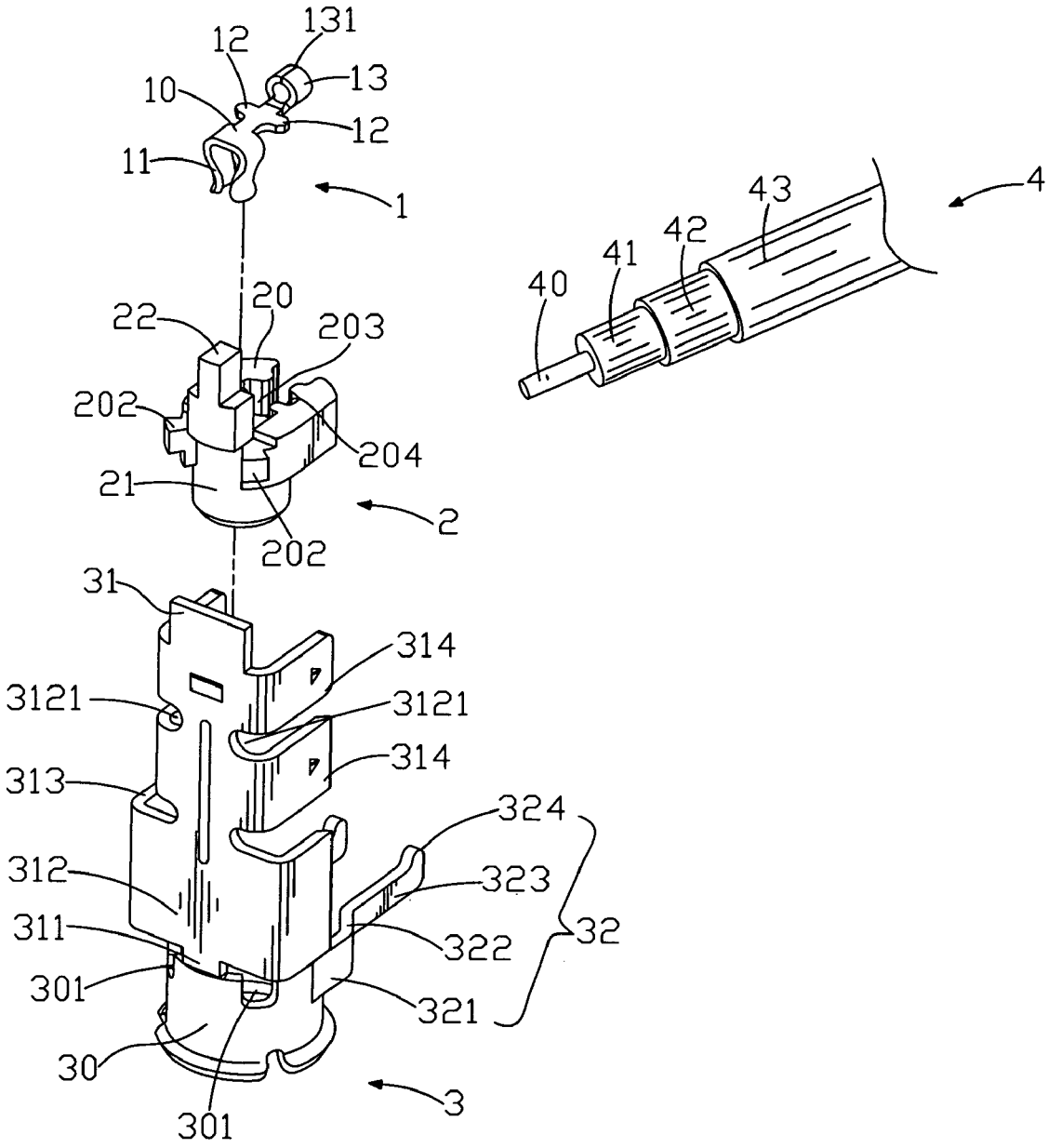
FIG. 3 is another exploded view of the coaxial connector and the coaxial cable in FIG. 2.

With reference to FIG. 2 and FIG. 3, a coaxial connector in accordance with the present invention includes a terminal 1 configured to be electrically connected to an coaxial cable 4, a dielectric housing 2 for receiving the terminal 1 therein and a conductor shell 3 to enclose and secure the housing 2 together with terminal 1 therein.

Particularly referring to FIG. 3, the coaxial cable 4 connected to the coaxial connector of the invention includes an inner conductor 40, a conductive braiding layer 42, an inner insulator 41 separating the inner conductor 40 and the conductive braiding layer 42, and an outer insulator 43 surrounding the braiding layer 42.

Referring to FIGS. 2 and 3 again, the terminal 1 includes a base 10. A pair of mating wings 11 each extends downward from opposite lateral sides of the base 10 and projects toward each other respectively for griping a mating of a complementary connector (not shown). The tips of the mating wings 11 show a shape of lip. A contact portion 13 extends upward from the opposite lateral sides of the base 10 and is bent inward to form a cylindrical shape. The contact portion 13 is apart from the mating wings 11. A pair of retaining portions 12 protrudes outward from the opposite lateral sides of the base 10 and is located between the contact portion 13 and the mating wings 11.

The dielectric housing 2 includes a base portion 20, a tubular portion 21 underneath the base portion 20 and an inner cover portion 22 extending upward from a top surface of the base portion 20. A passageway 201 passes through the base portion 20 and the tubular portion 21. Two engaging blocks 202 protrude outward from an outer surface of the base portion 20. An accommodation space 203 is defined in a rear area of the base portion 20 and communicates with the passageway 201. Two indentations 204 are defined on an inner surface around the accommodation space 203 to communicate with the accommodation space 203 and face to each other for accommodating the two retaining portions 12 to fix the terminal 1 inside the dielectric housing 2.

The conductor shell 3 includes a substantially cylindrical sleeve portion 30 and an outer cover portion 31 connected to the sleeve portion 30. When the outer cover portion 31 is not bent, it is substantially perpendicular to the sleeve portion 30.

Two notches 301 are defined in the sleeve portion 30 to engage with the two engaging blocks 202 of the dielectric housing 2 for positioning the dielectric housing 2 in the sleeve portion 30 of the conductor shell 3. Two arms 32 extend rearward from two sides of an upper portion of the sleeve portion 30. Each arm 32 has an extending portion 321, and a connecting portion 322 extending from the extending portion 321 and bending inward. A holding portion 323 extends from a free end of the connecting portion 322. The extending portion 321 and the connecting portion 322 abut against the base portion 20 of the dielectric housing 2. The two holding portions 323 hold the braiding layer 42 of the coaxial cable 4 therebetween. Each holding portion 323 defines a hook 324 at a tip end thereof.

The outer cover portion 31 has a bending portion 311 connected to the sleeve portion 30. A flat trunk portion 312 extends upward and outward from the bending portion 311. A pair of tabs 313 and two pairs of fixing portions 314 extend outward from the opposite lateral sides of the flat trunk portion 312 in turn from bottom to top. A retaining groove 3121 is formed in the flat trunk portion 312 between the two pairs of fixing portions 314. Each fixing portion 314 has a bulge 3141 protruding inward therefrom.

Figure 4:
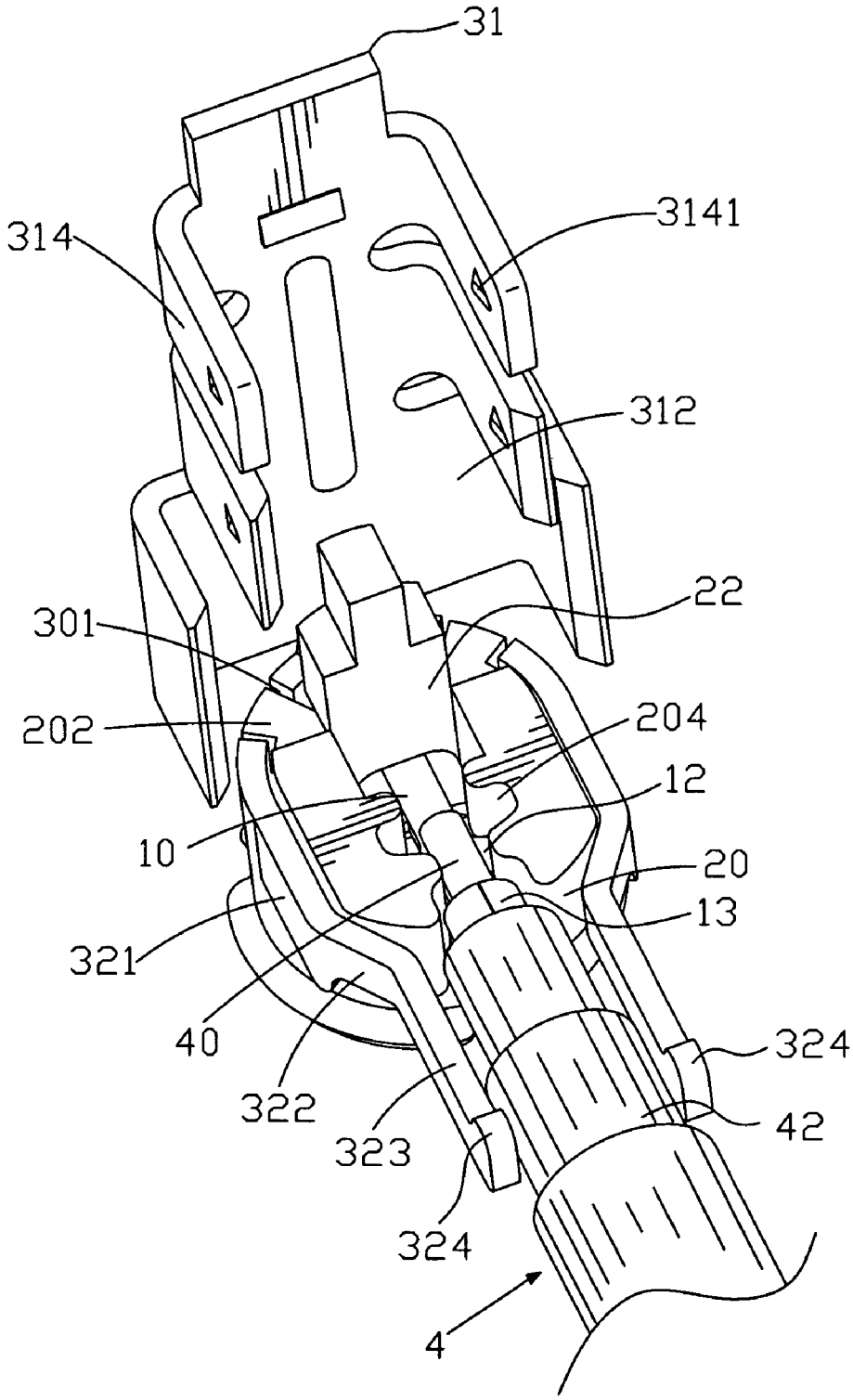
FIG. 4 shows the assembling process of the coaxial connector with the coaxial cable in FIG. 2.
Figure 5:
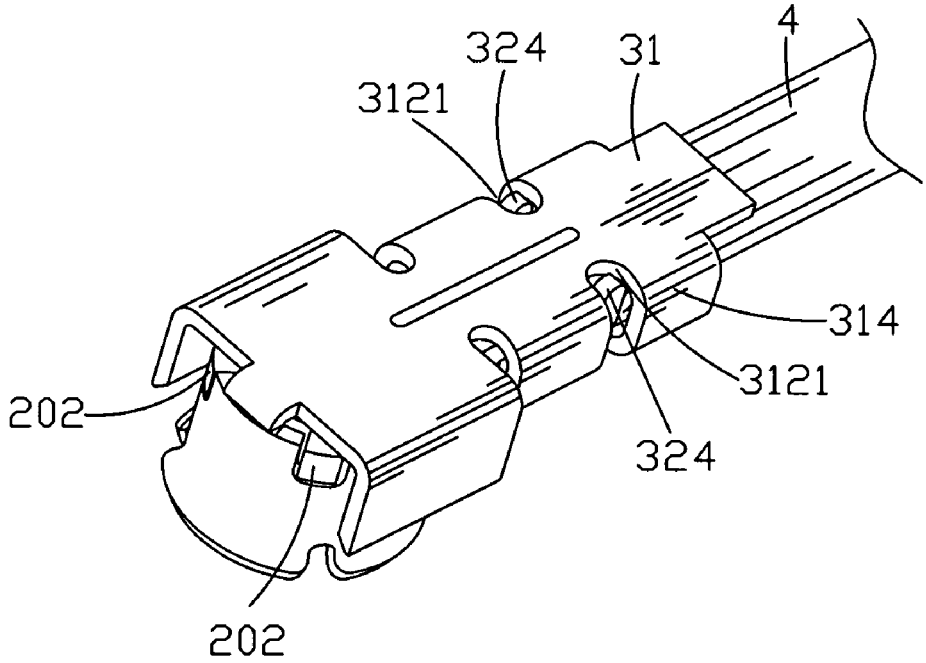
FIG. 5 is an assembled view of the coaxial connector and the coaxial cable in FIG. 2.
Figure 6:
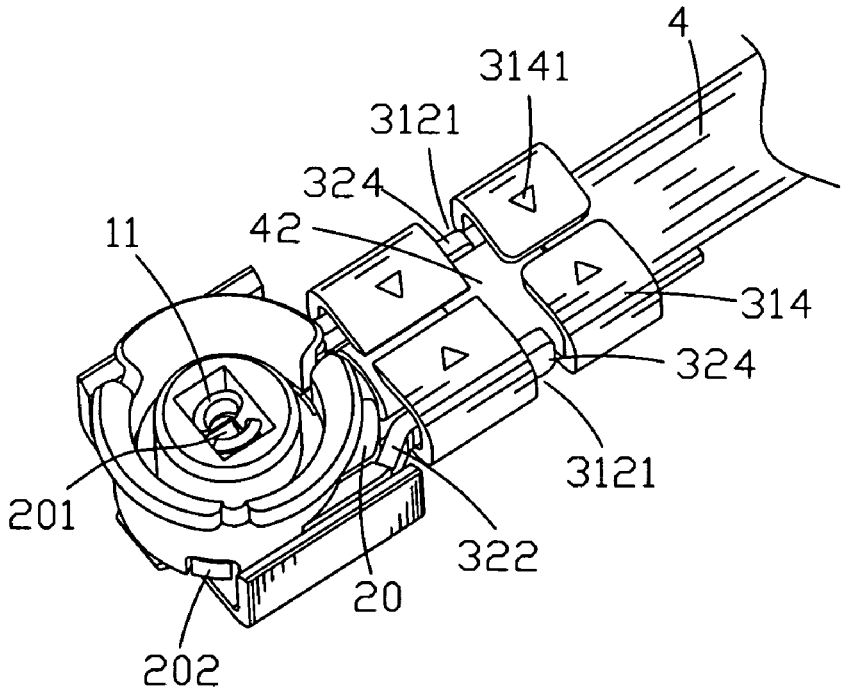
FIG. 6 is another view of the coaxial connector and the coaxial cable in FIG. 5.

With reference to FIGS. 4-6, the coaxial connector of the present invention is assembled as follows.

(1) The inner conductor 40 of the coaxial cable 4 passes the contact portion 13 of the terminal 1 and then physically and electrically presses against the base 10.

(2) The terminal 1 assembled with the coaxial cable 4 is then placed in the dielectric housing 2. More specifically, the mating wings 11 are inserted into the passageway 201 such that the base 10 and the contact portion 13 are confined in the accommodation space 203, while the two retaining portions 12 are fitted into the two indentations 204 respectively for fixing the terminal 1 along with part of the conductor 40 inside the dielectric housing 2.

(3) The sleeve portion 30 of the conductor shell 3 encircles the base portion 20 and the tubular portion 21 of the dielectric housing 2 with the engaging blocks 202 engaging with the notches 301 and the extending portion 321 and the connecting portion 322 abutting against the rear of the base portion 21 of the dielectric housing 2. The braiding layer 42 is clamped by the pair of holding portions 323 cooperatively.

(4) The outer cover portion 31 of the conductor shell 3 is bent at a right angle to press down and bend the inner cover portion 22 of the dielectric housing 2 to cover the inner conductor 40 inside the dielectric housing 2. When the outer cover portion 31 is fully bent, the hook 324 is inserted into the retaining groove 3121.

(5) The tabs 313 encircle the sleeve portion 30. The two pairs of the fixing portions 314 are bent to encircle the arms 32 and the coaxial cable 4.

As described above, the arms 32 of the conductor shell 3 provide hooks 324 which may be inserted into the retaining groove 3121 of the outer cover portion 31 to fix the outer cover portion 31 in right position, which prevents the outer cover portion 31 diverging from the direction of the axis of the coaxial cable 4. Besides, the retaining portions 12 of the terminal 1 are jammed in the indentations 204 for fixing the terminal 1 inside the dielectric housing 2 firmly. The extending portion 321 and the connecting portion 322 abut against the rear of the dielectric housing 2 and the engaging blocks 202 engage with the notches 301 for fixing the dielectric housing 2 inside the conductor shell 3. The bulges 3141 on the fixing portions 314 of the conductor shell 3 squeeze the coaxial cable 4 for holding the coaxial cable 4 tightly. Furthermore, the shape of the tips of the mating wings 11 is a lip, which is convenient for insertion of the complementary connector into the connector of the invention.

An embodiment of the present invention has been discussed in detail. However, this embodiment is merely a specific example for clarifying the technical contents of the present invention and the present invention is not to be construed in a restricted sense as limited to this specific example. Such modifications and variations that may be apparent to those skilled in the art are intended to be included within the scope of this invention as defined by the accompanying claims.

What is claimed is:

1. A coaxial connector adapted to be assembled to a coaxial cable having an inner conductor and a braiding layer enclosing the inner conductor, comprising:

a dielectric housing having a base portion and a tubular portion underneath the base portion, a passageway being defined in both the base portion and the tubular portion, an accommodation space being defined in the base portion and communicating with the passageway for accommodating the inner conductor therein;

a terminal received in the passageway and the accommodation space of the housing and physically and electrically connected with the inner conductor of the coaxial cable; and a conductor shell including a sleeve portion for accommodating the base portion and the tubular portion of the dielectric housing, and an outer cover portion for covering the base portion and holding the coaxial cable, two arms extending from two sides of an upper portion of the sleeve portion for holding the braiding layer of the coaxial cable therebetween, each of the two arms defining a hook at a tip end thereof, the outer cover portion defining two retaining grooves at two sides thereof for holding the two hooks when the conductor shell holds the coaxial cable.

2. The coaxial connector as claimed in claim 1, wherein the arm has an extending portion disposed at the upper portion of the sleeve portion and a connecting portion extending from the extending portion and bending inward, a holding portion extends from a free end of the connecting portion, the extending portion and the connecting portion abut against the base portion of the dielectric housing, and the holding portions hold the braiding layer of the coaxial cable therebetween, the hook is defined at the tip end of each holding portion.

3. The coaxial connector as claimed in claim 1, wherein the outer cover portion of the conductor shell has at least one pair of fixing portions at two sides thereof for being bent to fixing the coaxial cable therebetween, each of the fixing portions has a bulge protruding inward for squeezing the coaxial cable.

4. The coaxial connector as claimed in claim 1, wherein the terminal has a base extending lengthwise, a pair of mating wings extends downward from opposite lateral sides of the base and is received in the passageway of the dielectric housing, a contact portion extends upward from the opposite lateral sides of the base and is bent inward to form a cylindrical shape, the contact portion is apart from the mating wings, the inner conductor of the coaxial cable is placed on the base through the contact portion, a pair of retaining portions protrudes outward from the opposite lateral sides of the base and is located between the contact portion and the mating wings.

5. The coaxial connector as claimed in claim 4, wherein the base portion of the dielectric housing defines two indentations communicating with the accommodation space and facing each other for accommodating the two retaining portions of the terminal.

* * * * *